United States Patent [19]

Hippensteel et al.

[11] 4,324,055

[45] Apr. 13, 1982

[54] MOLDBOARD SUPPORT ASSEMBLY

[75] Inventors: John H. Hippensteel, Newville, Pa.; Rupert J. Brady, Bethesda, Md.

[73] Assignee: Richard P. Valk, Carlisle, Pa.

[21] Appl. No.: 170,793

[22] Filed: Jul. 21, 1980

[51] Int. Cl.[3] ..... E01H 5/04

[52] U.S. Cl. ..... 37/42 VL; 37/50; 172/796; 172/820

[58] Field of Search ..... 37/50, 41, 42 R, 42 VL, 37/51, 52, 29, 32, 35, 17; 172/818, 819, 820, 793, 796, 791, 792, 742, 447, 477

[56] References Cited

U.S. PATENT DOCUMENTS

| | | | |
|---|---|---|---|
| 2,195,306 | 3/1940 | Henry et al. | 172/796 |
| 2,488,016 | 11/1949 | Lado | 172/793 X |
| 3,464,129 | 9/1969 | Bogenschutz | 37/42 VL X |
| 3,604,131 | 9/1971 | Bogenschutz et al. | 37/42 VL |
| 4,016,936 | 4/1977 | Easterling et al. | 172/793 X |
| 4,238,895 | 12/1980 | Hetrick | 37/41 |

*Primary Examiner*—Edgar S. Burr
*Assistant Examiner*—Moshe I. Cohen
*Attorney, Agent, or Firm*—Brady, O'Boyle & Gates

[57] ABSTRACT

A moldboard support assembly including a drive frame assembly having one end connectable to the front end of a vehicle. A blade and moldboard support frame is pivotally connected to the other end of the drive frame for pivotal movement about a vertical axis. The blade and moldboard support frame includes a gear segment driven by a worm gear mounted on the drive frame assembly to effect the pivotal movement of the blade and moldboard, and wear pads are mounted on the drive frame assembly and engage surfaces on the moldboard support frame, to thereby maintain the drive frame assembly and moldboard support frame in alignment to insure proper intermeshing of the worm gear and gear segment.

12 Claims, 3 Drawing Figures

FIG. 1
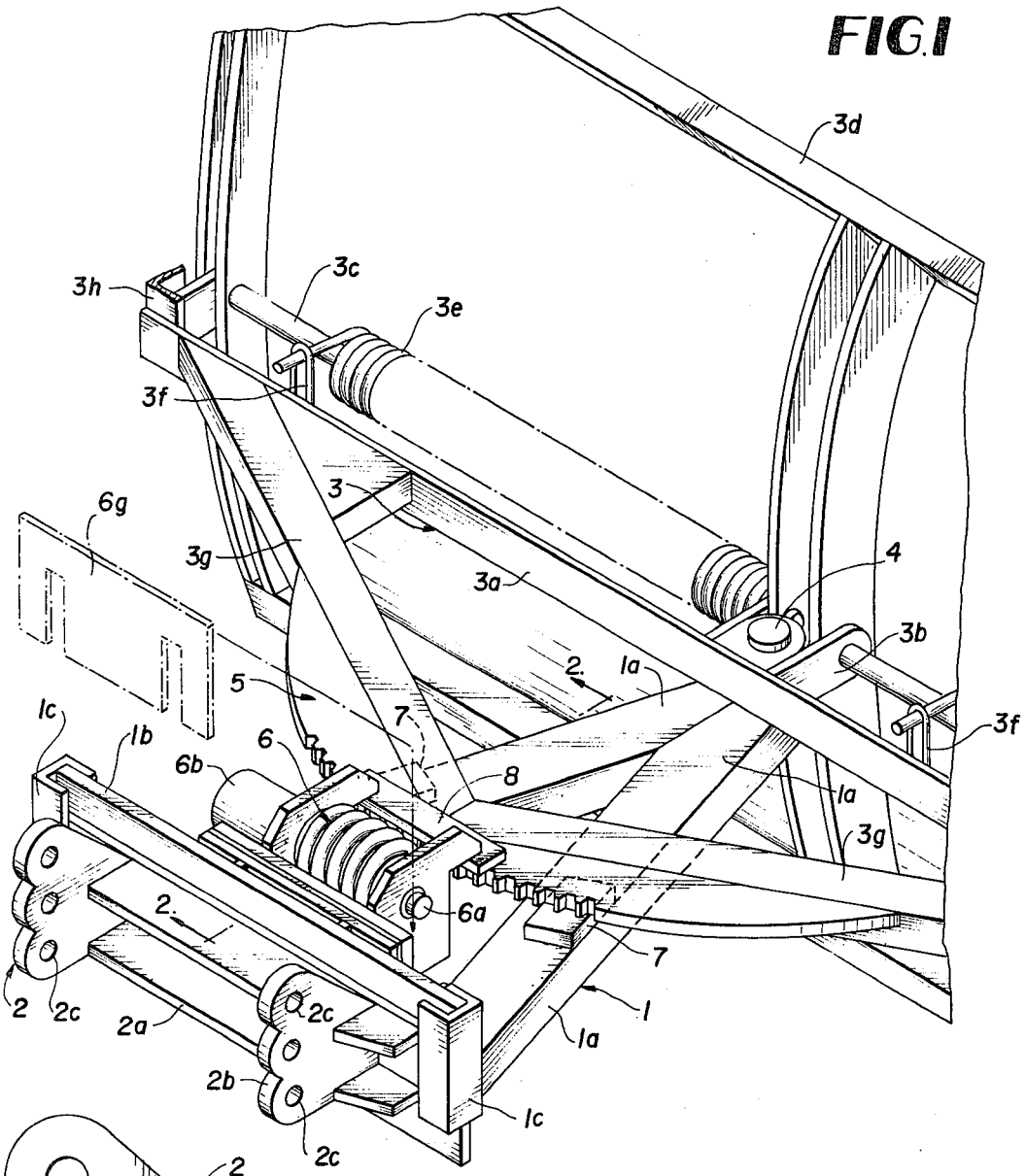
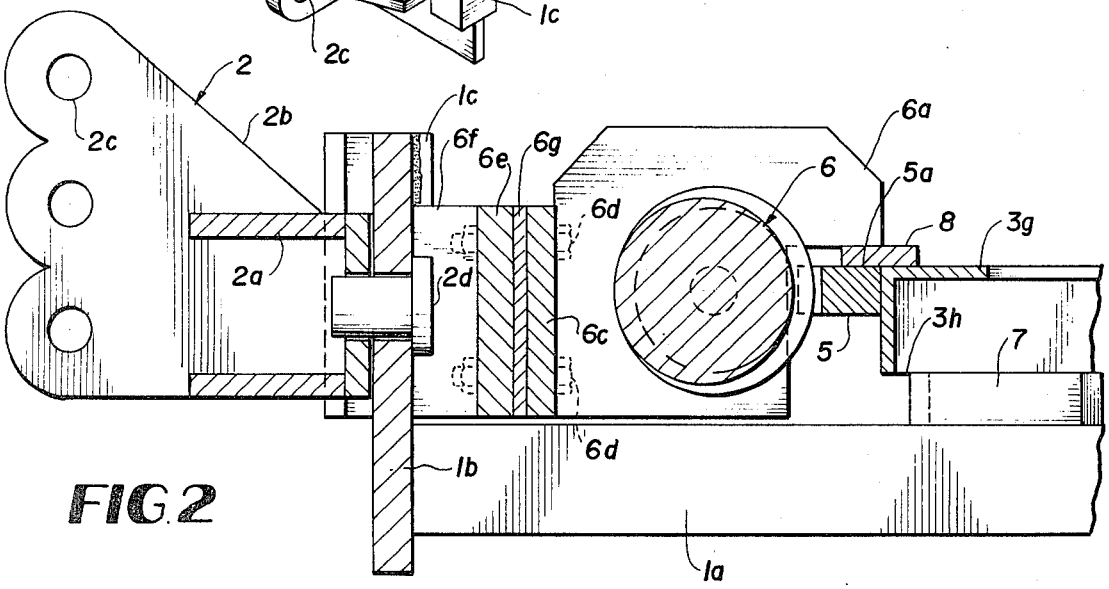
FIG. 2

MOLDBOARD SUPPORT ASSEMBLY

BACKGROUND OF THE INVENTION

Moldboard support assemblies of the type wherein the moldboard support frame is pivotally connected to one end of a vehicle supported drive frame for pivotal movement about a vertical axis are known, as evidenced by U.S. Pat. No. 3,464,129 to Bogenschutz, dated Sept. 2, 1969; and U.S. Pat. No. 3,604,131 to Bogenschutz, dated Sept. 14, 1971. The pivotal movement of the moldboard support frame about the vertical axis is accomplished by a motor driven worm gear, carried by the drive frame, intermeshing with a gear segment connected to the moldboard support frame. In order to maintain the drive frame and moldboard support frame in proper alignment, a suitable guide is provided between the frames. The guide is provided in Bogenschutz, U.S. Pat. No. 3,464,129, by a guide member connected to the moldboard support frame and slidably mounted in a slot formed in a guide block connected to the drive frame.

While Bogenschutz's guide arrangement is satisfactory for its intended purpose, it is subject to certain objections, particularly the expense incurred in fabricating the various components to make up the guide arrangement. After considerable research and experimentation, the guide arrangement of the present invention has been devised which is considered an improvement on Bogenschutz's guide arrangement, and comprises, essentially, a pair of bearing blocks or wear pads mounted on the drive frame and engaging the bottom surface of a frame component in the moldboard support frame. Another wear pad is connected to the worm gear support brackets and engages the top surface of the gear segment. By this construction and arrangement, the wear pads forming the guide arrangement are connected to the drive frame only, whereby conventional moldboard support frames having gear segments are readily attachable to the drive frame of the present invention and are properly guided thereby. Furthermore, the worm gear support brackets perform the dual function of not only supporting the worm gear but also support the wear pad engaging the top surface of the gear segment.

BRIEF DESCRIPTION OF THE DRAWINGS

FIG. 1 is a fragmentary, perspective view of the moldboard support assembly of the present invention;

FIG. 2 is a view taken along line 2—2 of FIG. 1; and

DESCRIPTION OF THE PREFERRED EMBODIMENT

Figure 3:
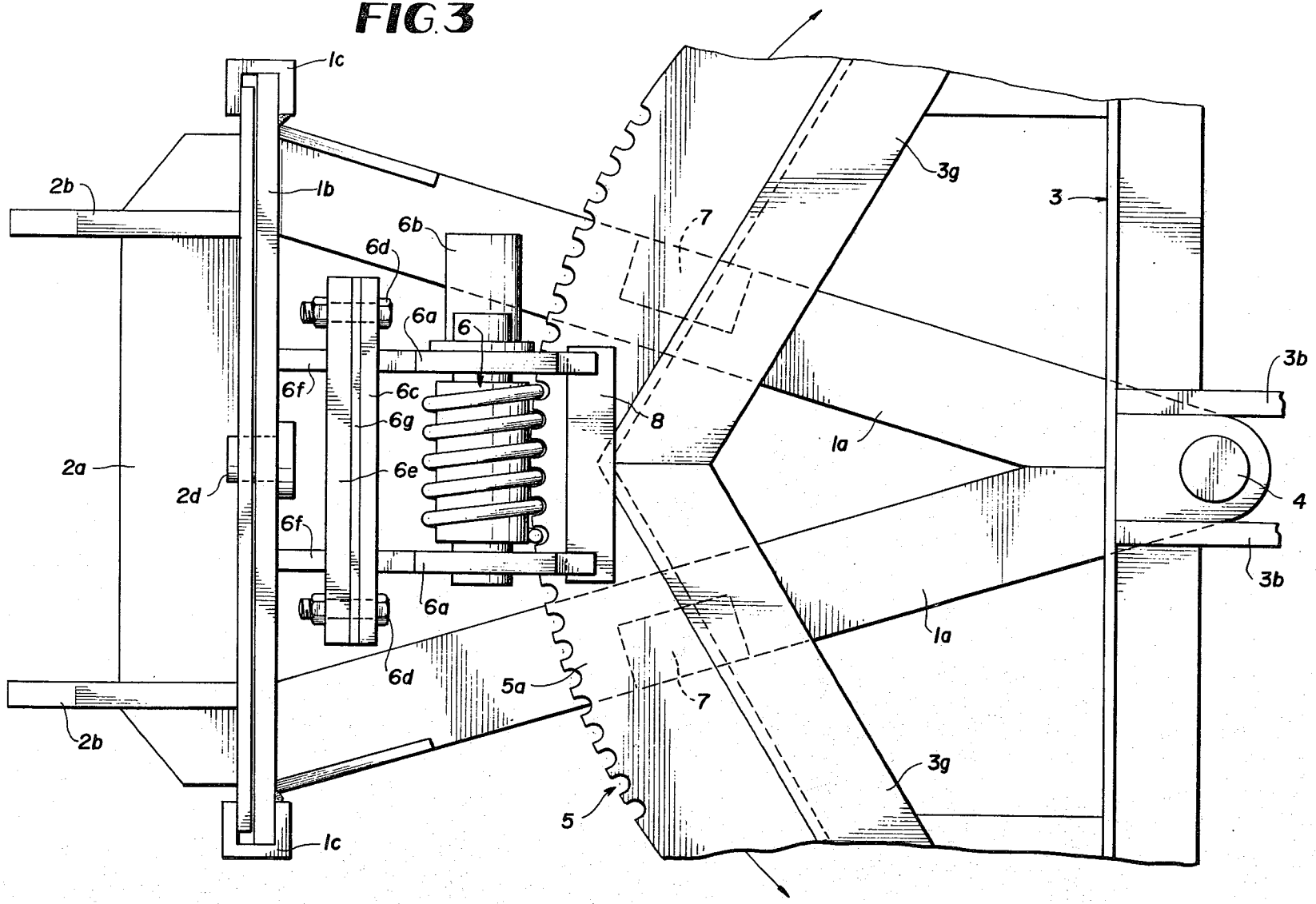
FIG. 3 is a fragmentary, top plan view of the moldboard support assembly of the present invention.

Referring to the drawings and more particularly to FIG. 1 thereof, the moldboard support assembly of the present invention includes a drive frame assembly 1 having one end 2 adapted to be connected to the front end of a vehicle. A blade and moldboard support frame 3 is pivotally connected as at 4 to the other end of the drive frame for pivotal movement about a vertical axis. The blade and moldboard support frame 3 includes a gear segment 5 driven by worm gear 6 mounted on drive frame assembly 1. Wear pads 7 and 8 are mounted on the drive frame assembly 1 and engage the bottom surface of a frame component in the moldboard frame and the top surface of the gear segment 5, to thereby maintain the drive frame assembly 1 and moldboard support frame 3 in alignment to insure proper intermeshing of the gear segment 5 and worm gear 6.

The details of the construction of the drive frame assembly 1 and moldboard support frame 3 are shown in FIGS. 1 and 3 wherein the drive frame assembly 1 comprises a pair of integral converging frame members **1*a* having their convergent ends pivotally connected as at 4 to the moldboard support frame 3, to be described more fully hereinafter. The opposite or divergent ends of the frame members 1*a* are integrally connected to a transverse frame member 1*b*. The end 2 of the drive frame assembly, which is adapted to be connected to the front end of a vehicle, comprises a transversely extending channel 2*a* (FIG. 2) having brackets 2*b* secured to opposite end portions thereof, the brackets 2*b* having apertures 2*c* for receiving pins (not shown), whereby the end of the drive frame assembly is pivotally connected to the front end of a motor vehicle. A pin 2*d* extends through the web of the channel member 2*a* and the transverse frame member 1*b* to allow pivotal movement about a horizontal axis between the end 2 of the drive frame assembly and the transverse frame member 1*b*, the pivotal movement being limited by vertically disposed channel members 1*c* secured to the ends of transverse frame member 1*b***.

The moldboard support frame 3 comprises a transversely extending angle iron **3*a* having brackets 3*b* positioned at each end and intermediate the ends thereof through which a rod 3*c* extends to which the moldboard 3*d* is pivotally mounted. The rod 3*c* extends through a pair of torsion springs 3*e*, each spring having one end connected to the angle iron as at 3*f*, and the other end connected to the moldboard 3*d*. By this construction and arrangement, the springs 3*e* yieldingly maintain the moldboard in the operative position and resist pivotal movement of the moldboard in the event the scraper blade on the moldboard strikes a fixed object. To complete the structure of the moldboard support frame 3, a pair of integral convergent angle irons 3*g* extend rearwardly from the moldboard 3*d* and have their divergent ends secured to the outer end portions of the angle iron 3*a*; the convergent portions of the frame members have the gear segment 5 secured thereto in such a manner that the upper surface 5*a* of the gear segment is flush with the upper surface of the angle irons 3*g*. A pair of wear pads 7 are mounted on the upper surface of the frame members 1*a* of the drive frame assembly and are adapted to support the lower edges 3*h* of the depending flanges of the angle irons 3*g* of the moldboard support frame 3**.

The upper wear pad 8, which engages the upper surface of the gear segment 5, is secured to the worm gear brackets **6*a*. The worm gear drive motor 6*b* is also supported by the brackets 6*a* which are rigidly connected to the transverse frame member 1*b* of the drive frame assembly 1 by a plate 6*c* bolted as at 6*d* to another plate 6*e* rigidly connected to the transverse frame member 1*b* by arm members 6*f*. A shim 6*g* is adapted to be inserted between the back and front faces, respectively, of the plates 6*c* and 6*e* to compensate for any normal wear between the teeth of the gear segment 5 and the worm gear 6. If the worm gear 6 or reversible drive motor 6*b* becomes damaged or fails, the entire unit can be quickly replaced with a spare drive motor and worm gear unit by removing and replacing the four bolts 6*d* and connecting the hydraulic lines to the replacement unit, thus reducing down-time for the plow. At the same time, a new upper wear pad 8** is installed simultaneously with the replacement unit.

The upper wear pad 8 is of a substantially large size. It can, for example, be approximately two inches wide and ten to eleven inches in length. This massive wear pad, which bears on the upper surface of the gear segment 5, and a portion of the upper surface of the convergent angle irons 3*g* when the plow is in its central position, efficiently transfers stresses in the support frame 3, particularly upward stress components, to the drive frame assembly 1, thus providing a more stable and rugged snow plow assembly.

The moldboard is maintained in selected position relative to the road surface by means of road surface contacting skid shoe assemblies of normal construction, not shown, connected at opposite ends of angle iron 3*a* of the support frame, or a chain type suspension system of the normal type connected between the support frame 3 and the support assembly on the front of the vehicle to which the plow is connected.

From the above description, it will be readily apparent to those skilled in the art that the construction and arrangement of the wear pads 7 and 8 provide an improved guide assembly between the drive frame assembly 1 and the blade and moldboard support frame 3, and by mounting the entire guide assembly on the drive frame assembly 1 rather than having one component of the guide assembly mounted on the drive frame assembly and another component of the guide assembly mounted on the moldboard support frame, as was done heretofore, conventional moldboard support frames having gear segments are readily attachable to the drive frame assembly of the present invention.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

We claim:

1. In a moldboard support assembly of the type having a blade and moldboard support frame pivotally connected to a drive frame assembly for pivotal movement about a vertical axis, the pivotal movement of the blade and moldboard support frame being effected by a gear segment on the blade and moldboard support frame being driven by a motor-driven worm gear mounted on the drive frame assembly, the improvement comprising, guide means mounted on the drive frame assembly and engaging upper and lower surfaces on the moldboard support frame to thereby maintain the drive frame assembly and moldboard support frame in alignment to insure proper intermeshing of the worm gear and gear segment, and said guide means including a bracket in which the worm gear is rotatably mounted, said bracket having a portion extending toward said vertical pivot axis into overlapping relation with at least the surface of the gear segment facing away from the drive frame assembly, and wear surface means connected to said bracket portion between said bracket portion and said gear segment surface and engaging said surface of the gear segment, whereby the bracket provides the dual function of supporting the worm gear and the wear surface means.

2. In a moldboard support assembly according to claim 1, in which motor means are mounted on said bracket and connected to drive said worm gear, and means releasably connecting said bracket to said drive frame assembly whereby said bracket, motor means, worm gear and said wear surface means can be quickly removed and replaced as a unit on said drive frame assembly.

3. In a moldboard support assembly according to claim 1, in which said bracket includes a pair of plates at opposite ends of the worm gear, and said plates each having a said portion extending toward said vertical axis into overlapping relation with the said surface of the gear segment.

4. In a moldboard support assembly according to claim 1, in which said wear surface means engages at least the surface of the gear segment that is adjacent and coextensive with the portion of the gear segment intermeshed with the worm gear.

5. In a moldboard support assembly according to claim 1, wherein the drive frame assembly includes a pair of convergent frame members having their convergent ends pivotally connected to the moldboard support frame at said vertical axis, the blade and moldboard support frame including a pair of convergent frame members having their divergent ends connected to the moldboard, said guide means including a pair of wear elements mounted on the upper surface of said convergent frame members of said drive frame assembly and engaging the lower surface of the convergent frame members of said moldboard support frame.

6. In a moldboard support assembly according to claim 5, wherein the gear segment is connected to the convergent end portions of the convergent frame members of the moldboard support frame and said wear surface means engaging the upper surface of the gear segment.

7. In a moldboard support assembly according to claim 1, wherein adjustment means are connected to the worm gear support bracket, whereby the worm gear can be adjusted relative to the gear segment to thereby compensate for normal wear of the gear teeth.

8. In a moldboard support assembly according to claim 7, wherein the adjustment means comprises a pair of spaced, transversely extending plates, one plate being connected to the worm gear bracket and the other plate being connected to the drive frame assembly, a shim mounted in the space between the plates, and bolt means interconnecting said plates and shim.

9. In a moldboard support assembly of the type having a drive frame assembly including a pair of convergent frame members, a blade and moldboard support frame pivotally connected to the convergent ends of the drive frame assembly for pivotal movement about a vertical axis, the blade and moldboard support frame including a pair of convergent frame members having their divergent ends connected to the moldboard, the pivotal movement of the blade and moldboard support frame being effected by a gear segment on the blade and moldboard support frame being driven by a motor-driven worm gear mounted on the drive frame assembly, the improvement comprising the gear segment connected to the convergent end portions of the convergent frame members of the moldboard support frame, a pair of wear pads mounted on the upper surface of said convergent frame members of said drive frame assembly and engaging the lower surface of the convergent frame members of said moldboard support frame, a bracket on the drive frame support assembly in which the worm gear is rotatably mounted, another wear pad connected to said bracket and engaging the upper surface of the gear segment to thereby maintain the drive frame assembly and moldboard support frame in alignment to insure proper intermeshing of the worm gear and gear segment, whereby the bracket provides the dual function of supporting the worm gear and said another wear pad which engages the upper surface of the gear segment.

10. In a moldboard support assembly according to claim 9, in which motor means are mounted on said bracket and connected to drive said worm gear, and means releasably connecting said bracket to said drive frame assembly whereby said bracket, motor means, worm gear and said another wear pad can by quickly removed and replaced as a unit on said drive frame assembly.

11. In a moldboard support assembly according to claim 9, wherein adjustment means are connected to the worm gear support bracket, whereby the worm gear can be adjusted relative to the gear segment to thereby compensate for normal wear of the gear teeth.

12. In a moldboard support assembly according to claim 11, wherein the adjustment means comprises a pair of spaced, transversely extending plates, one plate being connected to the worm gear bracket and the other plate being connected to the drive frame assembly, a shim mounted in the space between the plates, and bolt means interconnecting said plates and shim.

* * * * *